United States Patent [19]

Vice

[11] 4,043,466

[45] Aug. 23, 1977

[54] DUAL TRACK TRANSFER SYSTEM AND A TRANSFER CAR FOR USE THEREWITH

[75] Inventor: Earl C. Vice, Ashland, Ky.

[73] Assignee: Armco Steel Corporation, Middletown, Ohio

[21] Appl. No.: 677,711

[22] Filed: Apr. 16, 1976

[51] Int. Cl.[2] ..... F27B 3/18

[52] U.S. Cl. ..... 214/18 SC; 104/96; 105/177

[58] Field of Search ..... 104/48, 49, 1, 35, 87, 104/104, 105, 96; 105/157 R, 177, 216, 217; 214/38 CC, 18 SC, 35

[56] References Cited

FOREIGN PATENT DOCUMENTS 370,135 5/1973 U.S.S.R. ..... 104/96

OTHER PUBLICATIONS

Publication; Railroad Gazette, vol. 37, p. 544, Nov. 11, 1904.

*Primary Examiner*—Albert J. Makay

*Attorney, Agent, or Firm*—Melville, Strasser, Foster & Hoffman

[57] ABSTRACT

A dual track system whereby a transfer car can be turned at least 90° in a minimum amount of space. The track system comprises a first set of parallel railroad-type rails of a standard size and cross section for the wheels of the lead truck of a transfer car and a second set of parallel railroad-type rails of the same size and cross section for the wheels of the following truck of the same transfer car. The first and second sets of rails are parallel to each other and overlapped with the right hand rails of each set lying in close proximity to each other and the left hand rails of each set lying in close proximity to each other. At the point where the transfer car is to begin its 90° turn, the first set of rails has a curved portion which turns laterally away from the second set of rails while the second set of rails continues without direction change, the outside rail of the curved portion crossing one rail of the second set, whereby the lead truck of the transfer car turns and the following truck continues without direction change until the body of the transfer car is turned 90° to its original direction of travel. The invention further contemplates an improved transfer car of the type having a load supporting body mounted on pivot type trucks with standard flanged wheels.

10 Claims, 9 Drawing Figures

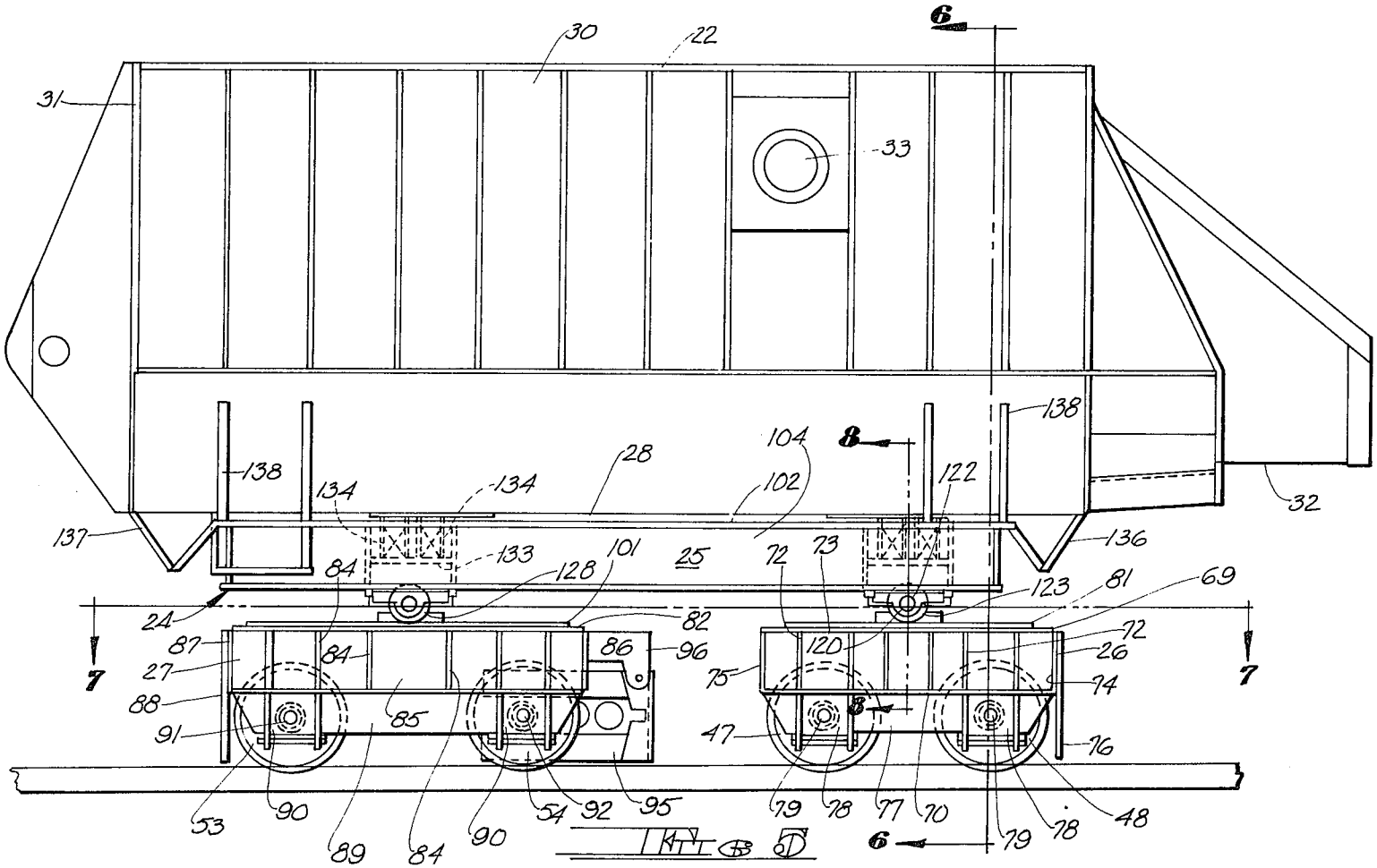
32
69
7
136
81
72
26
74
76
48
138
123
78
79
6
122
70
33
77
8
73
120
78
104
102
72
79
75
47
22
25
82
96
95
28
101
86
92
30
128
54
134
133
90
84
85
89
134
84
84
90
138
53
24
87
27
88
91
31
137
7
6

DUAL TRACK TRANSFER SYSTEM AND A TRANSFER CAR FOR USE THEREWITH

BACKGROUND OF THE INVENTION

1. Field of the Invention

The invention relates to a dual gauge track system and a transfer car therefore, and more particularly to such a system wherein the transfer car may travel from a loading position to an unloading position and be turned at least 90° at the unloading position in a minimum of space.

2. Description of the Prior Art

The track arrangement and transfer car therefor of the present invention may have many applications. While not intended to be so limited, for purposes of an exemplary showing the present invention will be described in its application to the transfer of scrap from a steel mill scrap yard building to the charging floor of a building containing one or more scrap melting furnaces such as, for example, basic oxygen furnaces. In the 43–44 steel mill layout, a track scale constitutes the starting point of the transfer car in the scrap yard building. The transfer car supports a large scrap box provided on its sides with trunnions. Once the scrap box is loaded with a desired amount of scrap the transfer car is conducted to the charging floor of the basic oxygen furnace building which is generally in line with the scrap yard building. In order for the hooks of an overhead crane in the basic oxygen furnace building to engage the trunnions of the scrap box to lift and shift the scrap box to its ultimate charging position, the transfer car and the scrap box mounted thereon must be turned 90° within the building. The charging floor affords minimum room to accomplish this turning of the transfer car.

The present practice is to rotate the transfer car on the charging floor by the use of a railroad-type turn table. The turn table is recessed in a concrete pit in the charging floor and is rotated on a circular rail by motor and gear reducer means. This means of rotating the transfer car is characterized by a number of deficiencies. First of all, the installation costs are high. In addition, maintance costs are also high and track alignment and control problems are inherent in the system.

Another approach to the problem of the turning of a transfer car is illustrated in U.S. Pat. No. 3,139,839. This approach utilizes a single track system with a branching spur. The track system requires special rail without benefit of frogs, some of which presents a broad flat top and some of which is longitudinally grooved. On the transfer car itself, swivel type trucks are provided, selected wheels of which are unflanged and the remaining wheels of which are provided with a central flange to engage that portion of the rail structure which is grooved. This arrangement assures that as the transfer car reaches the spur the lead truck will follow the spur and the following truck will continue with its direction of travel unchanged. This approach is also characterized by certain deficiencies. First of all it requires special track which in turn requires special patterns and is expensive and difficult to install. Excessive wear will occur on soft cast steel flat rail causing frequent rail replacement and shut-down time, both of which add to the expense. Since special track is required, the system cannot be tied into the regular railroad track system of a steel mill. The lead truck makes a full 90° turn to turn the transfer car and the spur therefor has a length of curve sufficient to enable this full 90° turn. As a result a short radius curve is required. This would not lend itself to the use of standard railroad rail, first of all because it is not a duel-track system, and secondly, because such a short radius curve would result in excessive friction between a standard flanged railroad-type wheel and the rail. Furthermore, the standard practice of reducing friction on short radius curves by spreading the gage could not be practiced in a situation utilizing a center flanged wheel and a grooved rail.

The system taught in the above mentioned patent would require the special rail to be cast in relatively short sections rather than using standard lengths of standard railroadtype rail. Difficulties would be encountered in providing a cast rail with a groove in the center of sufficient strength to support the wheel loadings contemplated with the steel mill scrap transfer car of the present invention. Assuming an eight wheeled transfer car, wheel loadings in excess of 36,000 pounds might well be experienced. Such wheel loadings would soon roll the special grooved rail flat, destroying its shape. Wheel loadings of this magnitude would also severly damage center flanged wheels of the type required by the patent. Finally, the accumulation of fine scrap in the groove of a grooved rail could cause a wedging of the center flanged wheels or a derailment.

The present invention provides a track system and transfer car therefor which obviates the above enumerated deficiencies. The system of the present invention requires only track maintance, having no alignment problems. Since standard rail and standard flanged wheels are used, installation costs are far less and maintance is considerably easier. The arrangement of the present invention has low power requirements and can be operated by a very simple control system.

In accordance with the system of the present invention, the outwardly turned lead truck rails are so configured that it is not necessary for the lead truck to turn 90° to achieve a 90° turn of the transfer car. This permits a larger radius for the curved portion of the lead truck rail set and enables the curved portion to be shorter. As a consequence of this, the lead truck of the transfer car will negotiate the turn with ease and friction between its wheels and the rails will be reduced. Far less space is required enabling two transfer systems of the present invention to be utilized on the same charging floor in a minimum space and without crossing each other. With minor modifications, the track system to be described may be used to turn the transfer car 180° or even 360°.

The track system of the present invention can be tied into or can be an integral part of the regular railroad track system of a steel mill, dpending upon the track gauge selected. Furthermore, the transfer car of the present invention demonstrates markedly improved stability.

SUMMARY OF THE INVENTION

The present invention provides a dual track system for turning a transfer car at least 90° in a minimum amount of space and a transfer car to be used with the track system. The track system itself comprises a first set of parallel railroad-type rails of standard size and cross section laid at a pre-determined gauge. This first set of rails is intended to be engaged by the wheels of the lead truck of the transfer car. A second set of parallel railroad-type rails of the same size, cross section and gauge is provided for the wheels of the following truck of the transfer car. Throughout most of the length of the track system, the first and second sets of rails are parallel to each other and are overlapped so that the right hand rails of each set lie in close proximity to each other and similarly the left hand rails of each set lie in close proximity to each other.

At the point where the transfer car is to be turned 90° the first set of rails for the wheels of the lead truck curve at a constant radius laterally away from the second set of rails, while the second set of rails continues without direction change. The outside rail of the curve crosses one rail of the second rail set which is provided with a standard frog for this purpose. The lateral curved portion of the first set of rails is of sufficient length that when the lead truck of the transfer car follows the curved portion of the first set of tracks and the following truck follows the second set of tracks, the car will be turned 90°. The lead truck of the transfer car will swivel less than 90° when the transfer car has turned 90°.

The transfer car may be caused to move along the first and second set of rails by an appropriate means. In a preferred embodiment, the following truck is powered by appropriate prime mover means.

If the second set of tracks extends slightly beyond that point wherein the car has attained its full 90° turn, and if the lead truck is also powered, the car may be caused to be turned a full 180°. By providing switches between the first and second set of tracks, the transfer car may indeed be turned a full 360°, all as will be described hereinafter.

The track system of the present invention is of such nature that two such systems may be located side-by-side with the curved portion of the first set of tracks of each system being of opposite hand. In this way two transfer cars can be turned at least 90° individually in a minimum amount of space and without the necessity of the rail sets of either system crossing those of the other.

The transfer car of the present invention comprises a load sustaining body supported on pivottype trucks each having two axles and employing standard flanged wheels. In the simpliest embodiment the following truck of the transfer car is powered by an electric motor, connected to a source of electricity by a cable and pay-off and take-up reel arrangement. While not necessary, it is preferable that both axles of the following truck are powered.

BRIEF DESCRIPTION OF THE DRAWINGS

FIG. 3 is a semi-diagrammatic plan view of one of the track systems of FIG. 2 and illustrates the turning of a scrap box bearing transfer car 90° thereon.

FIG. 5 is a side elevational view of the transfer car of the present invention with a scrap box shown mounted thereon.

DESCRIPTION OF THE PREFERRED EMBODIMENTS

Figure 1:
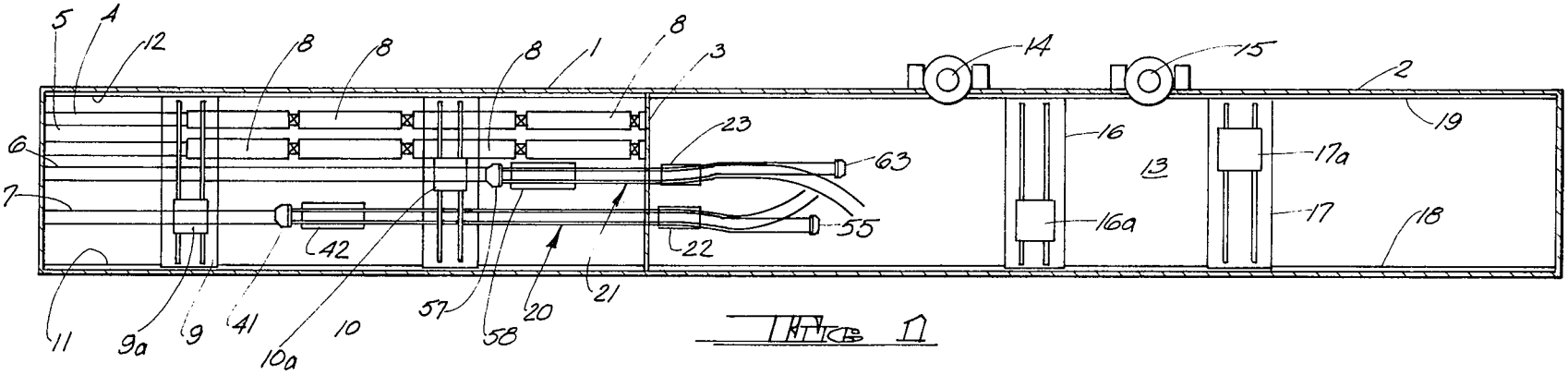
FIG. 1 is a semi-diagrammatic plan view of a steel mill scrap building and adjacent basic oxygen furnace building provided with a pair of track systems of the present invention.

FIG. 1 is a plan view illustrating in semi-diagrammatic fashion a typical steel mill scrap yard building-basic oxygen furnace building layout. The scrap yard building is shown at 1 and the basic oxygen furnace building is shown at 2. Buildings 1 and 2 are illustrated as being in alignment, although this is not a necessary limitation of the present invention. The buildings 1 and 2 are shown for purposes of clarity as being separated by a partition 3 it being understood that the partition 3 will have appropriate openings for the passage of the transfer cars to be described. Buildings 1 and 2 could constitute a single continuous structure. On the other hand, they can be wholly separate buildings, separated by a considerable distance. This would make no change in the track system of the present invention except to lengthen it.

The scrap yard building 1 is provided with a series of unloading tracks. The number of unloading tracks does not constitute a limitation on the present invention. Unloading tracks 4 and 7 are illustrated. Unloading tracks 4 and 5 are shown with a series of scrap cars 8 thereon. The scrap yard building 1 is served by a pair of overhead cranes 9 and 10. These cranes are capable of shifting back and forth longitudinally of the building on tracks 11 and 12. Cranes 9 and 10 have trolleys 9*a* and 10*a*, respectively. These trolleys are shiftable along their cranes transversely of the building and are provided with magnetic lifter means or other appropriate means by which scrap may be removed from cars 8.

The basic oxygen furnace building 2 defines a charging floor 13 serving a series of basic oxygen furnaces, two of which are shown at 14 and 15. Building 2 is provided with a pair of traveling cranes 16 and 17 shiftable longitudinally of the building along tracks 18 and 19. These cranes are provided with trolleys 16*a* and 17*a* shiftable along their respective cranes transversely of building 2.

In this exemplary embodiment, the system of the present invention provides means by which a scrap box may be loaded in the scrap yard building 1, transferred to the basic oxygen furnace building 2 and properly oriented therein for pick up by the trolley 16*a* of overhead crane 16 or the trolley 17*a* of overhead crane 17 by which its contents are charged into basic oxygen furnace 14 or 15. Again, for purposes of illustration, the buildings 1 and 2 are shown provided with a pair of track systems of the present invention (generally indicated at 20 and 21) so that two scrap boxes may be worked independently.

In FIG. 1 a scrap box 22 is shown in association with track system 20 and a scrap box 23 is shown in association with track system 21. It will be understood that scrap boxes 22 and 23 are mounted on transfer cars (not shown in FIG. 1), which in turn are mounted on track systems 20 and 21, respectively.

Turning to FIG. 5, scrap box 22 is shown mounted on a transfer car generally indicated at 24. Transfer car 24 comprises a body portion 25 having a pivot type lead truck 26 and a pivot type following truck 27.

Figure 6:
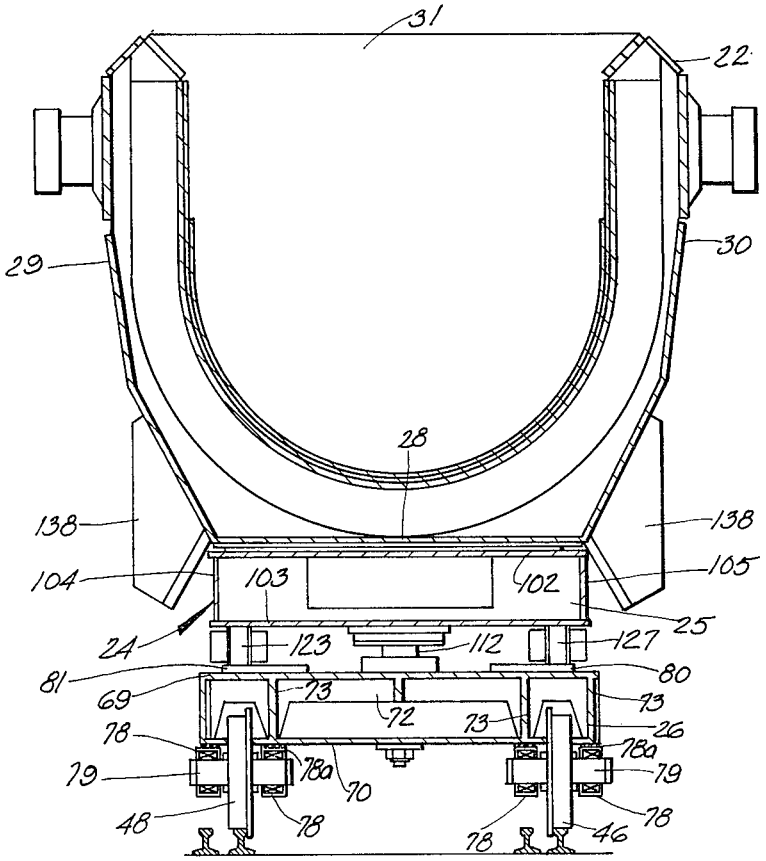
FIG. 6 is a cross sectional view taken along section line 6—6 of FIG. 5.

The precise nature and construction of scrap box 22 does not constitute a limitation on the present invention. Referring to FIGS. 3, 5 and 6 scrap box 22 is shown as having a flat bottom 28, longitudinal sides 29 and 30, a rearward end 31 and an open forward end in the form of a discharge spout 32. Longitudinal sides 29 and 30 bear trunnions 33 and 34, respectively by which scrap box 22 may be lifted and shifted by overhead crane 16 or overhead crane 17.

It will be understood that scrap box 23 and the transfer car upon which it rests will be identical to scrap box 22 and its transfer car 24. To this end, scrap box 23 is shown in FIG. 2 as having a rear end 35, longitudinal sides 36 and 37 with trunnions 38 and 39, respectively, and an open spout-like forward end 40.

Trolleys 16*a* and 17*a* of cranes 16 and 17, respectively, are provided with hooks (not shown) to engage the trunnions 33 and 34 of scrap box 22 or the trunnions 38 and 39 of scrap box 23. In order for the hooks of trolleys 16*a* or trolley 17*a* to engage the trunnions of either scrap box, it is necessary for each scrap box, once it enters the basic oxygen furnace building 2, to be turned 90° so that its long axis extends transversely of building 2 and its spout-like forward end (32 or 40) faces that wall of building 2 along which furnaces 14 and 15 are located. The problem is to accomplish this turning of scrap boxes 22 and 23 and the transfer cars upon which they are located within the minimal space afforded by charging floor 13.

Figure 2:
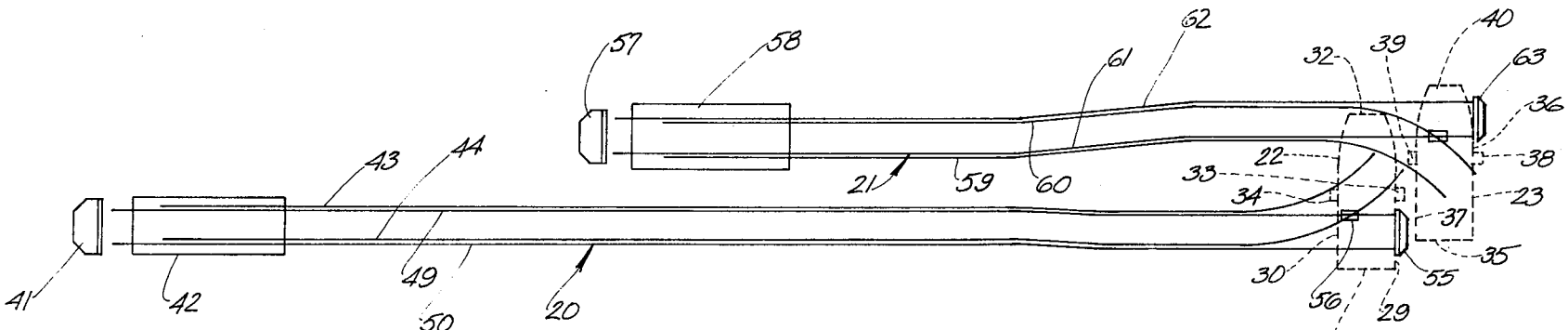
FIG. 2 is a semi-diagrammatic enlarged plan view of the pair of track systems of FIG. 1.

Turning first to track system 20, reference is made to FIGS. 1, 2 and 3. Track system 20 begins within scrap yard building 1 and is provided with a bumper 41 and a track scale 42. The track system is made up of a first set of rails 43 and 44. Rails 43 and 44 are railroad-type rails of standard size and cross section. Wheels 45 and 46 of transfer car lead truck 26 ride upon rail 43. Similarly, wheels 47 and 48 of lead truck 26 ride upon rails 44 (see FIG. 3). A second set of rails 49 and 50 are provided. Rails 49 and 50 are standard railroad-type rails of the same size and cross section as rails 43 and 44. Wheels 51 and 52 of transfer car trailing truck 27 ride upon rail 49 while wheels 53 and 54 of trailing truck 27 ride upon rail 50 (again see FIG. 3).

The first set of rails 43 and 44 and the second set of rails 49 and 50 are parallel to each other throughout the majority of the length of track system 20. It will be noted that the first set of rails 43 and 44 and the second set of rails 49 and 50 are overlapped with the result that rails 43 and 49 lie in close proximity to each other and rails 44 and 50 lie in close proximity to each other.

At the point where transfer car 24 is to begin its 90° turn within building 2, the first set of rails 43 and 44 has a curved portion of constant radius which turns laterally away from the second set of rails 49 and 50. Rails 49 and 50 continue without direction change, terminating at dead end bumper 55. It will be noted that rail 44 of the first rail set constitutes the outside rail of the curved portion and crosses rail 49 of the second rail set. A frog, diagrammatically indicated at 56 in FIGS. 2 and 3 is provided for this purpose.

The operation of track system 20 may be described as follows. Scrap box 22 on transfer car 24 is initially located in scrap yard building 1 on track scale 42. Scrap from scrap cars 8 is loaded into scrap box 22 by crane 9 or crane 10. In the particular exemplary embodiment described, the scrap will normally consist of heavy billet scrap and fine clip scrap. The fine clip scrap is placed in the front part of scrap box 22 to serve as a cushion for the heavy scrap as it is dumped into furnace 14 or furnace 15. When the desired scrap weight has been loaded into scrap box 22 the transfer car 24 is caused to move along track system 20 into the basic oxygen furnace building 2. Movement of transfer car 24 may be accomplished by any appropriate means. In the preferred embodiment the following truck 27 is powered by an electric motor. Within building 2 the lead truck 26 of transfer car 24 (see FIG. 3) will reach the curved portion of the first rail set 43and will follow the curved portion. Following truck 27 will continue on the second rail set 49–50 without direction change. The speed of the car will be reduced and the car will be stopped by abutment with deadend bumper 55. In FIG. 3, transfer car 24 and scrap box 22 are shown both in their normal position and in their unloading position (like parts having been given like index numerals).

As will be evident from FIG. 3, when transfer car 24 and scrap box 22 achieve their unloading position, the longitudinal center lines of transfer car body 25 and scrap box 22 are oriented substantially at right angles to tracks 49 and 50 of the second track set. The forward spout-like end 32 of scrap box 22 faces that wall of building 2 along which furnaces 14 snd 15 are located and trunnions 33 and 34 are properly oriented for pick up by the hooks of trolley 16*a* of crane 16 or trolley 17*a* of crane 17. Following truck 27 has not changed its direction but the center line of the following truck now lies substantially perpendicular to the center lines of transfer car body 25 and scrap box 22. The center line of lead truck 26 is non-parallel to the longitudinal center lines of transfer car body 25 and scrap box 22. At the same time, it will be noted that the center line of lead truck 26 lies in an angle of less than 90° to the rails 49 and 50 of the second rail set, the lead truck having been turned less than 90°.

Once scrap box 22 and transfer car 24 have achieved their unloading position, the trunnions 33 and 34 of scrap box 22 will be engaged by the hooks of trolley 16*a* of crane 16 or trolley 17*a* of crane 17 and the scrap box will be shifted longitudinally and transversely of building 2 to a charging position for furnace 14 or furnace 15. The contents of scrap box 22 will be charged into the desired one of the furnaces and the scrap box will thereafter be returned to its transfer car 24. Self powered following truck 27 will then be energized, reversing its direction, and the transfer car and scrap box will return to track scale 42 in preparation for another load.

As indicated above, FIGS. 1 and 2 illustrate a second track system 21 provided with a second transfer car (not shown) which may be identical to transfer car 24 and a second scrap box 23 identical to scrap box 22. With the provision of two track systems 20 and 21 the two scrap boxes 22 and 23 may be worked independently, doubling the scrap transfer capabilities. While, for purposes of an exemplary showing both scrap boxes 22 and 23 are shown in their unloading positions in FIG. 2, it will be understood that in normal operations only one scrap box at a time will be required in the unloading position.

Mechanically track system 21 is substantially identical to track system 20 being provided with a bumper 57 and a track scale 58 at its loading end within scrap yard building 1. A first set of rails 59 and 60 is provided for the lead truck of a transfer car and a second set of rails 61 and 62 is provided for the following truck of the transfer car. Again rails 59 through 62 may be standard railroad-type rails of the same size and cross section as rails 43, 44, 49 and 50 of track system 20. The first set of rails 59 and 60 for the transfer car lead truck has a curved portion of constant radius turning laterally away from the second set of rails 61 and 62 at the point where the transfer car and scrap box 23 are to be turned 90°. The second set of rails 61 and 62 for the trailing truck of the transfer car continue without direction change and terminate at dead end bumper 63.

Track system 21 differs from track system 20 in only two respects. First of all, the curved portion of the first rail set 59 and 60 is of opposite hand, curving toward first track system 20 to conserve the space required by both track systems within building 2. Secondly, scrap box 23 will be oppositely oriented on its transfer car with respect to scrap box 22 on its transfer car 24. It will be evident from FIG. 2 that when scrap box 22 and its transfer car are located on scale 42 of the first track system, the spout-like forward end 32 of scrap box 22 will face away from bumper 41. On the other hand, when scrap box 23 and its transfer car are located on scale 58, the spout-like forward end 40 of scrap box 23 will face bumper 57. As a result of this, scrap box 23 will be properly oriented when it and its transfer car achieve their unloading position.

While not required, that portion of both track systems 20 and 21 located within scrap yard building 1 are preferably of such length that if crane 10 is shifted to a parked position adjacent partition 3, scrap box 23 resting on scale 58 may be serviced by crane 9. In this way, both cranes can service both scrap boxes. Similarly, those portions of track systems 20 and 21 within the basic oxygen furnace building 2 are preferably of such length that if crane 16 is in a parked position adjacent partition 3, scrap box 22 can be serviced by crane 17. Thus both cranes 16 and 17 can be used to charge either furnace 14 or furnace 15 with either scrap box 22 or scrap box 23.

In a working example of the embodiment described with respect to FIGS. 1 and 2 above, each set of tracks in both track systems 20 and 21 was laid at a 7 foot gauge for stability. ARA 115 pound rail was used. The front trucks of the transfer cars utilized 30 inches diameter single flanged wheels at an axel spacing of 4 feet 0 inch. In order to conserve building space and to prevent the two track systems 20 and 21 from crossing each other (crossing frogs being expensive and a definite source of trouble), it is imperative to keep the truck length as short as possible. The curved portions of the lead truck tracks of both systems had a 38 foot 5 inch radius for the inside curved rail.

The wheels of the following trucks of the transfer cars may be of the same type, i.e. 30 inch diameter flanged wheels. Since these following trucks do not negotiate curved rails, their wheels may be located on centers separated by a greater distance for added stability. In the particular working example described, the wheels of the following trucks were located on 5 foot 11/8 inch centers.

In the working example being described the center-tocenter distance between the pivots of the lead and following trucks of each transfer car was 12 feet. Furthermore, those portions of track systems 20 and 21 at and immediately ahead of the points where the transfer cars are turned were separated by a centerline-to-centerline distance of 23 feet to prevent the systems from crossing. Any increase in car length would require a greater centerline-to-centerline distance between the track systems. The distance between the track systems in scrap yard building 1 is a matter of convenience and design choice.

In the working example, each transfer car was nearly 6 feet tall and weighed about 60,000 pounds. The scrap boxes were each about 110,000 pounds and each scrap box was intended to receive about 120,000 pounds of scrap. Thus each loaded scrap box-transfer car combination weighed about 290,000 pounds giving a wheel loading of approximately 36,250 pounds. Due to this size and weight the 7 foot track gauge was adopted for no reason other than to increase stability of the cars. In instances where stability is less of a factor, a standard 4 foot 8 and ½ inch gauge could readily be adopted and the track systems could be an integral part of the ordinary railway system of the steel mill since standard railroad rail and standard flanged wheels are used.

Figure 4:
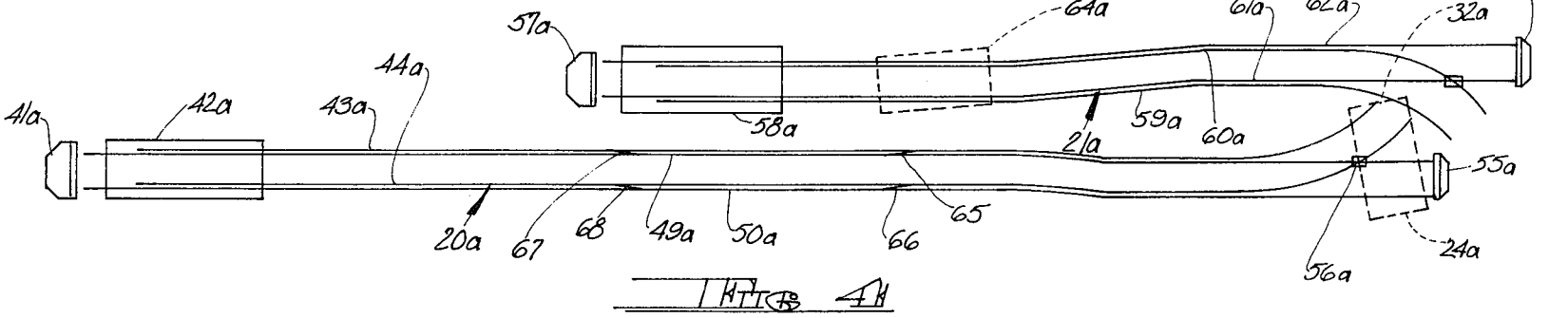
FIG. 4 is a semi-diagrammatic plan view of a modified version of the embodiment of FIG. 2.
Figure 2:
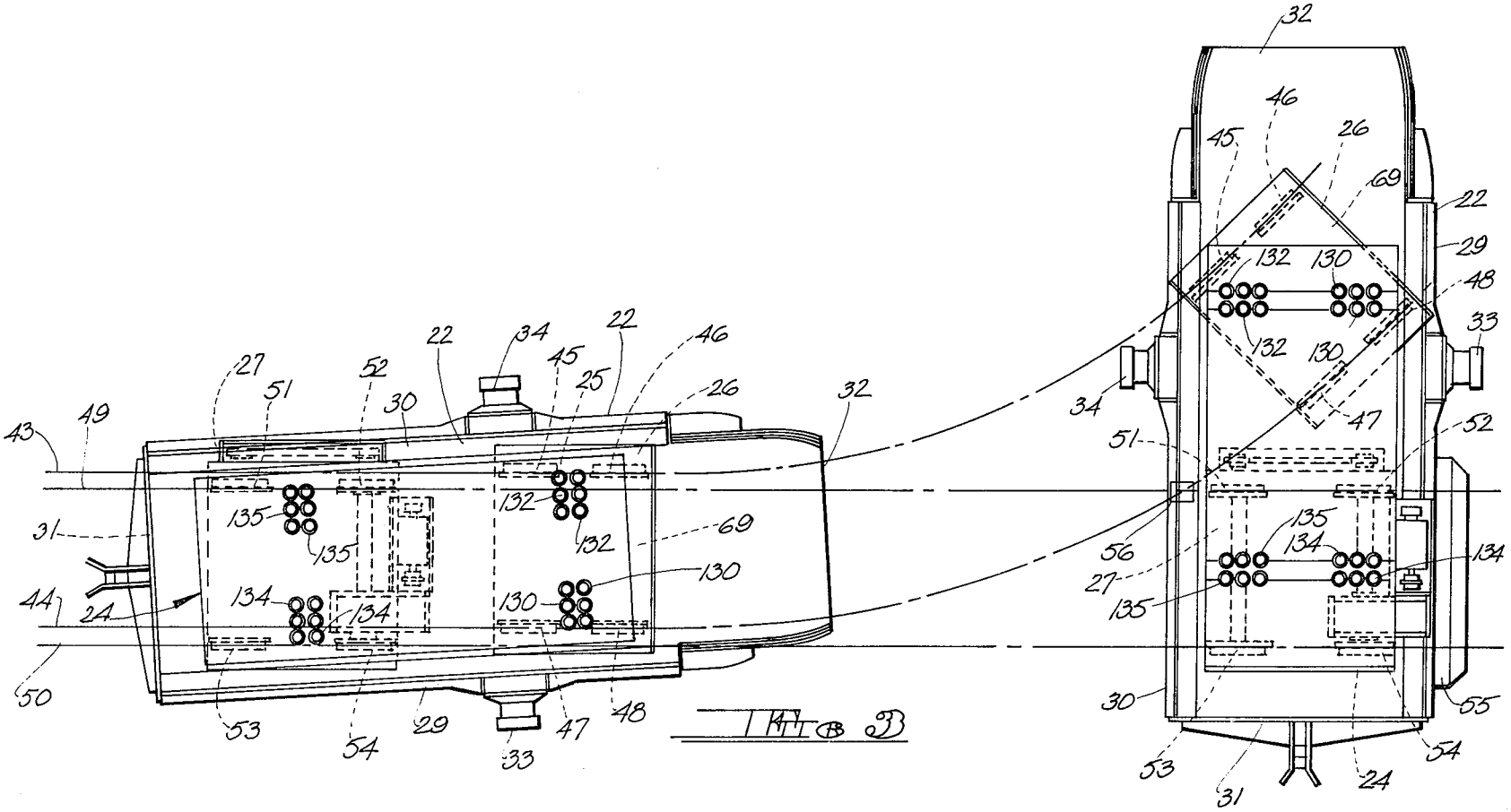

In some exemplary uses of the track system of the present invention it may be desirable to turn the transfer cars (whatever they may be intended to carry) 180°. Reference is made to FIG. 4 wherein a track system similar to FIG. 2 is illustrated and like parts have been given like index numerals followed by *a*. In FIG. 4 track system **20*a* is shown provided with transfer car 24*a* and track system 21*a* is shown provided with transfer car 64*a*, transfer cars 24*a* and 64*a* being identical. Track systems 20*a* and 21*a* of FIG. 4 are identical to track systems 20 and 21 of FIG. 2 with the exception that rails 49*a* and 50*a* of track system 20*a* (the rails for the following truck of transfer car 24*a*) have been slightly lengthened. The same is true of rails 61*a* and 62*a* of track system 21*a*. The only other difference between track systems 20*a* and 21*a* of FIG. 4 and track systems 20 and 21 of FIG. 2 lies in the fact that transfer cars 24*a* and 64*a*** have both their lead and following trucks independently powered.

It will be understood that transfer car **24*a* may be used in the same way on track system 20*a* as was described with respect to the transfer car and scrap box 22 on track system 20 of FIG. 2. In addition, however, by virtue of the fact that following truck rails 29*a* and 50*a* have been slightly extended, and because the lead truck of transfer car 24*a* is independently powered, transfer car 24*a* may be driven past the unloading position (described previously with respect to FIGS. 2 and 3) so that the longitudinal centerline of transfer car 24*a* passes beyond a position wherein it is perpendicular to rails 49*a* and 50*a*. This is accomplished by driving the following truck of transfer car 24*a* toward bumper 55*a* and simultaneously reversing the direction of travel of the lead truck of transfer car 24*a* so that it moves toward frog 56*a*. Once transfer car 24*a* has reached the position illustrated in FIG. 4, continued driving of the lead truck will cause the transfer car to turn a full 180°. When the car reaches scale 42*a* it will have been reversed end-for-end with its forward end facing bumper 41*a*. Transfer car 24*a* may be driven back to scale 42*a* by the lead truck only or by both trucks (if the direction of travel of the following truck is appropriately reversed). It will be understood that transfer car 64*a* may be caused to turn a full 180° in the same manner on track system 21*a***.

Track system **20*a* may be provided with a first pair of left hand crossover switches 65 and 66 and a second pair of right hand crossover switches 67 and 68. In the process of turning transfer car 24*a* 180°, as just described, if switches 65 and 66 are thrown to their crossover position, it will be understood that the leading truck of transfer car 24*a* will be switched to the following truck rails 49*a* and 50*a*. If switches 65 and 66 are returned to their normal positions, prior to passage of the following truck of transfer car 24*a* therethrough, both trucks of the transfer car 24*a* will be riding upon tracks 49*a* and 50*a*. If the lead truck of transfer car 24*a* passes through cross over switches 67 and 68 in their normal positions and then switches 67 and 68 are thrown to their cross-over position, the following truck of transfer car 24a will be switched to rails 43a and 44a. Thus, when the transfer car ultimately reaches track scale 42a it will have not only been turned 180°, but also its lead truck will now be mounted on tracks 49a and 50a and its following truck will now be mounted on tracks 43a and 44a. If, in this position the car is returned to the turning end of track system 20a (with switches 65 through 68 in their normal positions), and if the turning procedure above described is repeated a second time, and on the return trip to scale 42a the lead truck is again shifted to its tracks 43a and 44a by virtue of switches 67 and 68 and the following truck is returned to rails 49a and 50a via switches 65 and 66, the car will have turned a full 360°. The turning of transfer car 24a 180° or 360° is greatly facilitated by the fact that when the car is turned at the turning end of track system 20a that truck which occupies the curved portions of rails 43a and 44a never achieves a position wherein the center line of the truck is perpendicular to rails 49a and 50a. It will be understood that track system 21a may be provided with switches equivalent to switches 65 through 68 so that transfer car 64a** may also be rotated a full 360°. As indicated above, one or both of the transfer car trucks may be self-propelled by any appropriate means. When the trucks are electrically driven including cable means, accommodations must be made in the cable connection system to permit turning of the car.

FIGS. 5 through 9 illustrate the transfer car of the present invention. As indicated above, the transfer car comprises a body 25 to which is affixed a pivot-type lead truck 26 and a pivot-type following truck 27.

Figure 7:
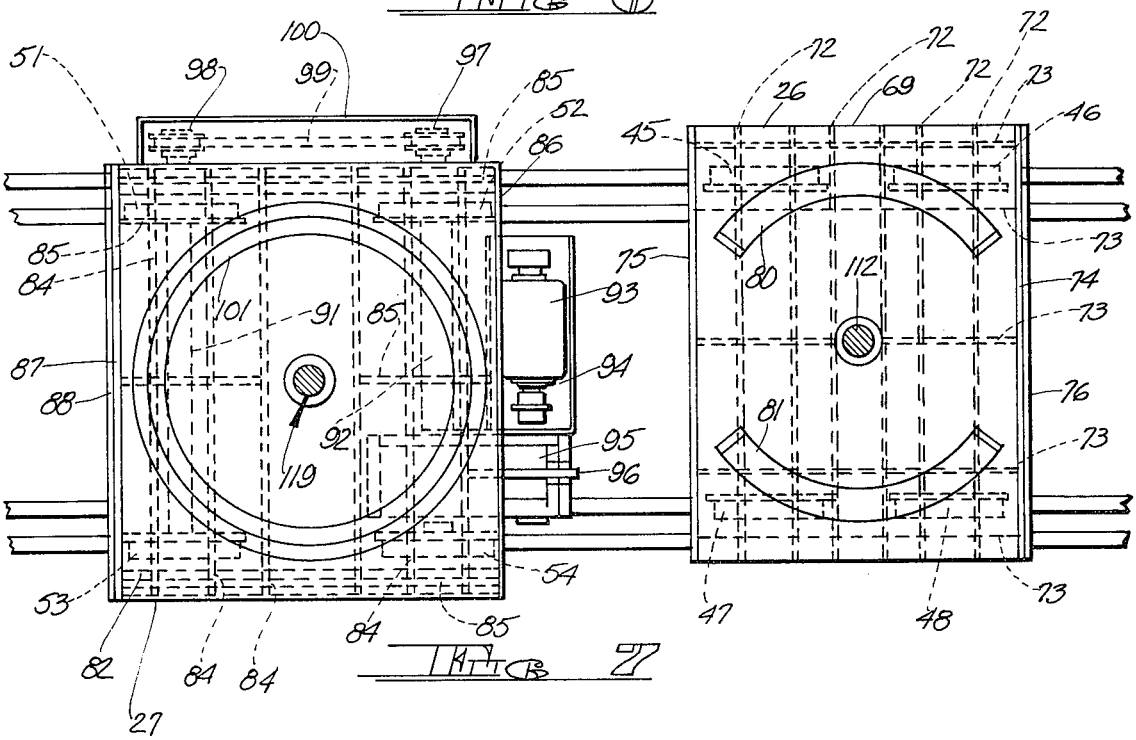
FIG. 7 is a cross sectional view taken along section line 7—7 of FIG. 5.

Lead truck 26 is most clearly shown in FIGS. 5 through 7. The truck is of welded construction and comprises a flat, horizontally oriented rectangular deck 69 and a lower plate 70 in parallel spaced relationship thereto. Deck 69 and plate 70 are joined by a plurality of transversely extending braces 72, a plurality of longitudinally extending braces 73, a forward end plate 74 and a rearward end plate 75. An additional plate 76 may be mounted on the forward end of the truck. Plate 76 depends downwardly nearly to the rails and serves to clear the rails of any obstruction. A series of additional structural members, one of which is shown at 77 in FIG. 5, extends downwardly from lower plate 70 and supports bearing means 78 for the axles 79 of standard flanged wheels 45, 46, 47 and 48. Resilient pads 78a of rubber or the like may be located immediately above bearings 78 to cushion them. The horizontal deck 69 of lead truck 26 carries on its upper surface a pair of flat, arcuate tracks 80 and 81, each of which may be made up of one or more arcuate plates.

Figure 9:
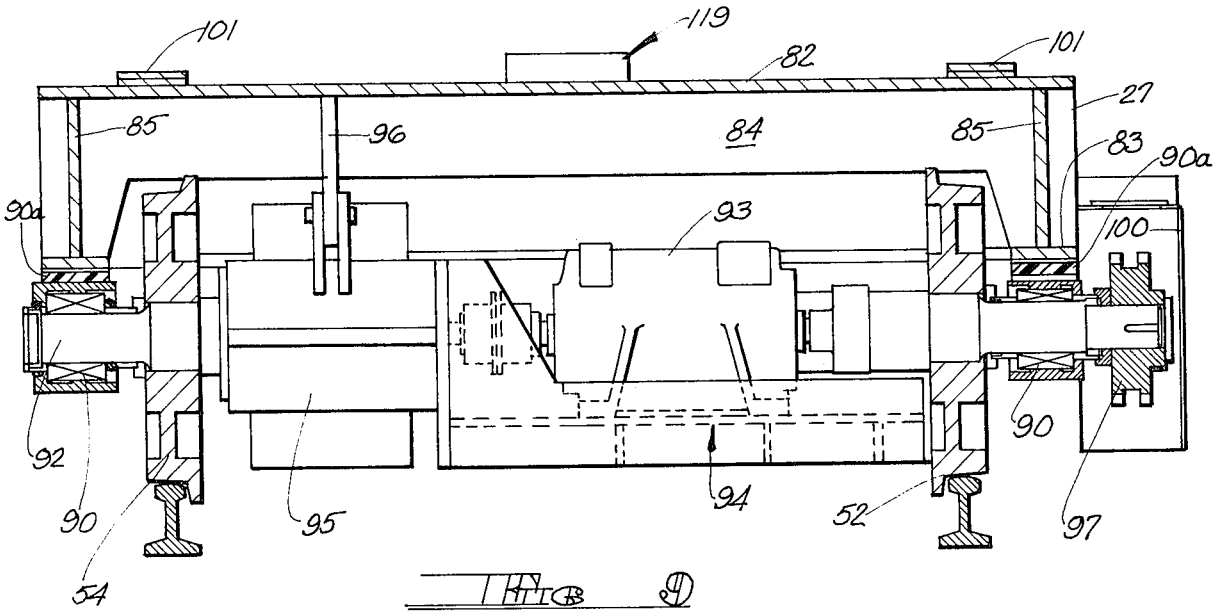
FIG. 9 is an end elevational view (partly in cross section) of the following truck of FIG. 5, as seen from the right in that figure.

Following truck 27 is most clearly shown in FIGS. 7 and 9. Following truck 27 is similar in construction to lead truck 26, being made up of a plurality of metallic welded elements comprising a flat, horizontal, rectangular deck 82, a lower plate 83, a plurality of transverse braces 84 and a plurality of longitudinal braces 85. A forward end plate 86 is provided, together with a rearward end plate 87 to which an additional end plate 88 may be affixed. End plate 88 extends downwardly nearly to the tracks and serves the same purpose as end plate 76 on lead truck 26.

A plurality of structural members, one of which is shown at 89 in FIG. 5, extend below lower plate 83 and support bearing means 90 for the axle 91 of standard flange wheels 51 and 53 and axle 92 of flange wheels 52 and 54. It will be noted that unlike truck 26 where each wheel is provided with its own individual axle 79, front wheels 52 and 54 of the following truck are mounted on the same axle 92 while rear wheels 51 and 53 are mounted on axle 90. Bearings 90 may also be surmounted by rubber pads or the like (shown at 90a in FIG. 9) serving the same purpose as resilient pads 78a of FIG. 6.

As indicated above, in the preferred embodiment the following truck of transfer car 24 is powered by an appropriate prime mover. For purposes of an exemplary showing, following truck 27 is illustrated as being provided with an electric motor 93 (see FIGS. 7 and 9) mounted on appropriate support means generally indicated at 94 and constituting a part of truck 27. Motor 93 drives axle 92 through an appropriate gear unit 95. Gear unit 95 may be of any suitable and well known type and is supported at its rearward end by axle 92 and at its forward end by brakes 96 affixed to truck 27. Power may be supplied to motor 93 by a cable and cable payoff reel assembly (not shown), as is well known in the art.

In most instances, the driving of axle 92 by motor 93 will be adequate to shift transfer car 24 along its track system. Where, for reasons of limited space, lead truck 26 is required to negotiate a minimum radius curve, it is preferable to drive axle 91 of following truck 27 as well. To this end, axles 91 and 92 extend beyond truck 27 at one side thereof and are provided with sprockets 97 and 98. Sprockets 97 and 98 are connected by a drive chain 99 (see FIG. 7). Sprockets 97 and 98 and drive chain 99 may be provided with a protective cover 100.

To complete truck 27, its horizontal deck 82 is provided with a flat, circular track 101 which may be made up of one or more plate thicknesses. The purpose of circular track 101 will be described hereinafter.

The body 25 of transfer car 24 is a generally rectangular, welded, metallic structure. Car body 25 comprises a rectangular, horizontal, flat upper deck 102 a lower plate 103 in parallel spaced relationship to deck 102 and join thereto by side sills 104 and 105 and longitudinally extending center sill plates 106 and 107 (see FIG. 8). Additional longitudinal and transverse bracing between deck 102 and lower plate 103 may be provided, as desired.

Near its forward end, car body 25 is provided with a pivot pin housing 108 located between center sill plates 106 and 107 and affixed to the center sill plates and to bottom plate 103 by reinforcing elements 109 and 110. Pivot pin housing 108 is provided with a cover 111. Pivot pin 112 is located within housing 108 between thrust bearings 113 and 114. Housing 108 is provided at its lower end with a cover member 115 through which pivot pin 112 extends and which is provided with an appropriate seal 116.

Figure 8:
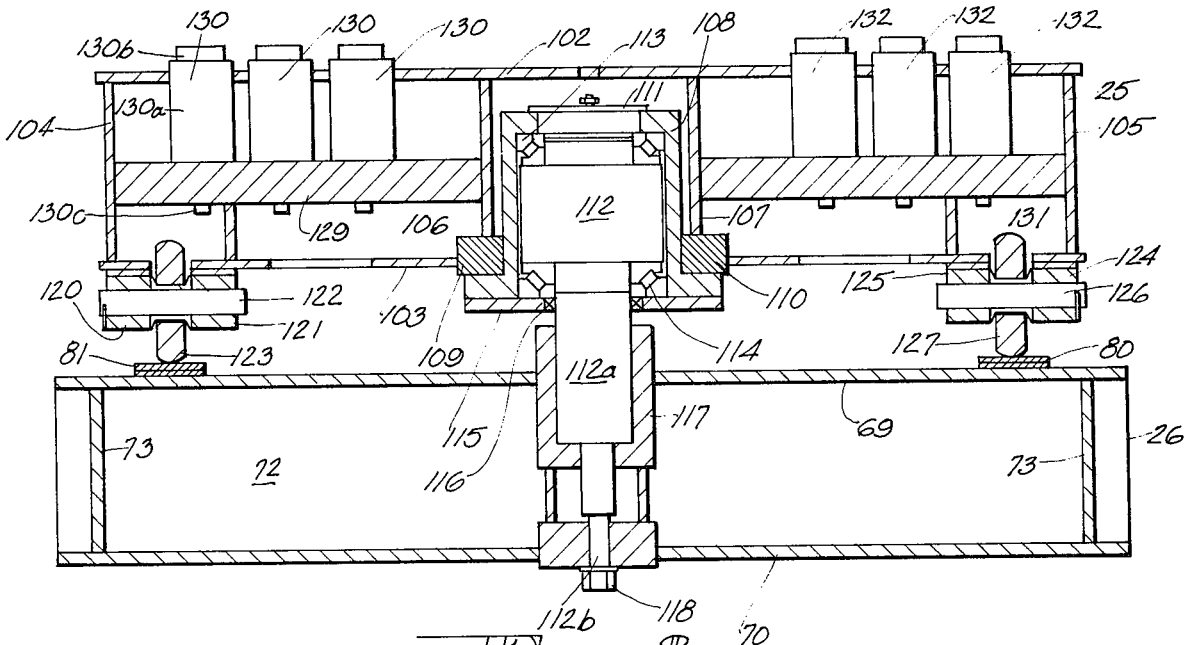
FIG. 8 is a cross sectional view taken along section line 8—8 of FIG. 5.

FIG. 8 also illustrates the upper portion of lead truck 26. A pivot pin socket 117 is affixed to lower plate 70 and deck 69, extending upwardly through deck 69. The lower portion 112a of pivot pin 112 extends into socket 117 with an extended portion 112b passing through the socket to a position below lower plate 70 and provided with a nut 118. Pivot pin 112 is non-rotatable with respect to lead truck 26. The assembly just described provides an anti-friction bearing by means of which lead truck 26 can pivot or swivel with respect to car body 25. It will be understood that a similar pivot pin assembly will be provided near the rearward end of car body 25 for following truck 27. Such a pivot pin assembly is generally indicated at 119 in FIG. 7.

As shown in FIG. 8, car body 25 is provided with downwardly depending bearings 120 and 121 supporting axle 122 with a roller 123 mounted thereon. Roller 123 is adapted to ride upon plate-like track 81 on deck 69 of lead truck 26. A second set of bearings 124 and 125 support an axle 126 and a roller 127 adapted to ride on arcuate plate-like track 80 of lead truck deck 69. Axles 122 and 126 are coaxial and intersect the axis of pivot pin 112. Rollers 123 and 127, located to either side of pivot pin 112, cooperate with their respective plate-like arcuate tracks 81 and 80 to serve as stabalizing means to prevent a roll motion of car body 25. It will be understood that the rearward end of car body 25 will be provided with an additional identical pair of rollers (one of which is shown at 128 in FIG. 5). These last mentioned rollers will be located to either side of pivot pin assembly 119 and will cooperate with circular plate-like track 101 on the deck 82 of following truck 27 to again serve as stabilizing means.

Returning to FIG. 8 it will be noted that to one side of the pivot pin assembly, car body 25 is provided with an additional horizontal brace member 129 which supports 6 dentical draft gear-type shock absorbers 130 (see FIG. 3). Shock absorbers 130 are identical and are of known construction, each comprising a hollow cylindrical body 130*a* extending through a perforation in deck 102 and a metallic disk 130*b* slidable within the body 130*a* and supported on a plurality of rubber disks (not shown) within body 130*a*. Metallic disk 130*b* has a downwardly depending guide pin 130*c* which passes through perforations in the rubber disks within body 130*a* and a perforation in brace member 129.

On the opposite side of the guide pin assembly and in diametrically opposed position, car body 25 is provided with a second brace member 131 similar to brace member 129. Brace member 131 supports a series of six shock absorbers 132 (see FIG. 3) which extend above the deck 102 of car body 25. Shock absorbers 132 are identical to shock absorbers 130.

Car body 25 will be provided with brace members similar to brace members 129 and 131 to either side of pivot assembly 119. One such brace member is shown at 133 in FIG. 5. These brace members support a first series of shock absorbers 134 and a second set of shock absorbers 135, both identical to shock absorbers 130 (see FIG. 3). The shock absorbers 130, 132, 134 and 135 serve to absorb the shock on transfer car body 25 and trucks 26 and 27 when the scrap box 22 is placed thereon and when scrap is loaded into the scrap box.

Finally, it will be noted that the scrap box 22 is provided with forward guide means 136, rearward guide means 137 and side guide means 138 (see FIGS. 5 and 6) by which the scrap box 22 may be properly located during placement on transfer car 24. By locating the guides on the scrap box itself, rather than on car body 25, the car body requires less reinforcement.

Modifications may be made in the invention without departing from the spirit of it. As indicated above, to enable the location of two track systems of the present invention in a minimal space a minimum radius of 38 feet 5 inches was used in the particular exemplary working example described above. This, in turn, required the wheels on lead truck 26 to be located at centers not more than about 4 feet apart. The same would be true of following truck 27 if the transfer car is intended to be turned a full 360°, as described with respect to FIG. 4. Where space is not a primary factor, the track radius can be increased permitting greater wheel span on the transfer car trucks. This, in turn, will increase the stability of the transfer car.

The embodiments of the invention in which an exclusive property or privilege is claimed are defined as follows:

1. A dual track transfer system for shifting a transfer car between first and second stations and for turning in a minimum amount of space said transfer car at said second station at least 90° to its direction of travel immediately prior to its turning, said system comprising a transfer car having a body, a lead truck and a following truck both pivotally mounted on said body, said lead and following trucks each having at least four standard flanged wheels, a first set of parallel railroad-type rails, said wheels of said lead truck being mounted on said first set of rails, a second set of parallel railroad-type rails, said wheels of said following truck being mounted on said second set of rails, said first and second sets of rails being parallel to each other and overlapped with the right hand rails of each set lying in close proximity to each other and the left hand rails of each set lying in close proximity to each other, at a point near said second station where said transfer car is to begin said at least 90° turn said first set of rails having a curved portion turning laterally away from said second set of rails with the outside rail of said curved portion crossing that one of said rails of said second set which lies between said rails of said first set, said second set of rails continuing from said point where said transfer car is to begin said turn without direction change whereby said lead truck will follow said curved portion of said first rail set and said following truck will continue on said second rail set until said transfer car has turned said at least 90°, said curved portion of said first track set being of such radius and length that the centerline of said lead truck will lie at an angle of less than 90° to said rails of said second set when said car body has turned said at least 90° and means for shifting said transfer car between said first and second stations along said first and second rail sets.

2. The structure claimed in claim 1 wherein said transfer car is self-propelled.

3. The structure claimed in claim 1 wherein said second set of rails terminates at said second station at a dead end bumper so positioned as to stop said transfer car when the longitudinal centerline of said transfer car body lies at 90° to said second set of rails.

4. The structure claimed in claim 1 wherein both said lead truck and said following truck are individually powered and said second set of rails from said point where said transfer car is to begin said turn is of such length as to permit said car body to achieve a position wherein its longitudinal centerline lies at an angle greater than 90° to said second set of rails, whereby when said transfer car is shifted toward said first station by said lead truck said car body will have turned 180°.

5. The structure claimed in claim 1 wherein said first station is located in the scrap yard building of a steel mill, a scrap box with laterally extending trunnions being mounted on said transfer car, said first station comprising a loading station at which scrap is loaded into said scrap box, said second station being located on the charging floor of a steel mill building containing at least one melting furnace, at least one overhead crane within said furnace building, said second station comprising an unloading station at which said trunnions of said scrap box are engaged by said crane and said scrap box is lifted from said transfer car by said crane and shifted to said furnace for the charging of said scrap into said furnace.

6. The structure claimed in claim 1 including a second dual track transfer system for shifting a second transfer car between said first and second stations and for turning in a minimum amount of space said second transfer car at said second station at least 90° to its direction of travel immediately prior to its turning, said second transfer system comprising said second transfer car having a body with a lead truck and following truck pivotally mounted thereon, each of said lead and following trucks of said second car body having at least four standard flanged wheels, said second system having a first set of parallel railroad-type rails for the wheels of said lead truck of said second transfer car and a second set of parallel railroad-type rails for the wheels of said following truck of said second transfer car, said first and second sets of rails of said second track system being parallel to each other and overlapped with the right hand rails of each set lying in close proximity to each other, at a point near said second station where said second transfer car is to begin said at least 90° turn said first set of rails of said second track system having a curved portion turning laterally away from said second rail set of said second system with the outside rail of said last mentioned curved portion crossing that one of said rails of said last mentioned second rail set which lies between the rails of said last mentioned first rail set, said last mentioned second rail set continuing from said point where said second transfer car is to begin said turn without direction change whereby said second transfer car lead truck will follow said curved portion of said last mentioned first rail set and said second transfer car following truck will continue on said last mentioned second rail set until said body of said second transfer car has turned said at least 90°, said last mentioned curved rail portion being of such length and radius that the centerline of said lead truck of said second transfer car will lie at an angle of less than 90° to said rails of said last mentioned second set when said body of said second transfer car has turned said at least 90° and means for shifting said second transfer car between said first and second stations along said first and second rail sets of said second track system.

7. The structure claimed in claim 4 including a left hand switch and a right hand switch between said right hand rails of said first and second sets and a left hand switch and a right hand switch between said left hand rails of said first and second sets, whereby said lead truck and said following truck may be interchanged between said first and second rail sets permitting said transfer car to be turned 360° on said dual track transfer system.

8. The structure claimed in claim 6 wherein said first and second transfer systems are parallel to each other, said curved portion of said first rail set of each of said first and second transfer systems turning toward the other of said first and second transfer systems without intersecting it.

9. The structure claimed in claim 8 wherein said first and second transfer cars are self-propelled.

10. The structure claimed in claim 8 wherein each said second rail sets of each of said first and second transfer systems terminates in a dead end bumper so positioned as to stop the respective one of said first and second transfer cars when the longitudinal centerline of its car body lies at 90° to the rails of its respective one of said second rail sets.

* * * * *